US010305180B2

(12) United States Patent
Ling

(10) Patent No.: US 10,305,180 B2
(45) Date of Patent: May 28, 2019

(54) SATELLITE RECEPTION ASSEMBLY WITH PHASED HORN ARRAY

(71) Applicant: MaxLinear, Inc., Carlsbad, CA (US)

(72) Inventor: Curtis Ling, Carlsbad, CA (US)

(73) Assignee: Maxlinear, Inc., Carlsbad, CA (US)

( * ) Notice: Subject to any disclaimer, the term of this patent is extended or adjusted under 35 U.S.C. 154(b) by 532 days.

(21) Appl. No.: 14/157,028

(22) Filed: Jan. 16, 2014

(65) Prior Publication Data

US 2014/0197986 A1 Jul. 17, 2014

Related U.S. Application Data

(60) Provisional application No. 61/753,138, filed on Jan. 16, 2013.

(51) Int. Cl.

| | |
|---|---|
| ***H01Q 3/26*** | (2006.01) |
| ***H01Q 19/17*** | (2006.01) |
| ***H01Q 21/06*** | (2006.01) |

(52) U.S. Cl.

CPC ..... *H01Q 3/26* (2013.01); *H01Q 19/17* (2013.01); *H01Q 21/064* (2013.01)

(58) Field of Classification Search

CPC ..... H01Q 3/26; H01Q 19/17; H01Q 19/132

USPC ..... 342/351–353

See application file for complete search history.

(56) References Cited

U.S. PATENT DOCUMENTS

| | | | | |
|---|---|---|---|---|
| 4,283,795 | A * | 8/1981 | Steinberger | H04B 7/002 342/361 |
| 4,485,383 | A * | 11/1984 | Maher | G01S 19/24 342/352 |
| 4,878,061 | A * | 10/1989 | Nusair | H01Q 13/0275 343/786 |
| 6,366,256 | B1 | 4/2002 | Ramanujam et al. | |
| 8,466,850 | B1 * | 6/2013 | Ling | H01Q 21/28 343/727 |
| 2001/0054984 | A1 * | 12/2001 | Spirtus | H01Q 1/125 343/840 |
| 2005/0146476 | A1 | 7/2005 | Wang et al. | |
| 2005/0285773 | A1 * | 12/2005 | Hartzstein | G01S 7/032 342/70 |
| 2008/0209478 | A1 * | 8/2008 | Santoru | H04H 20/12 725/68 |
| 2010/0117893 | A1 * | 5/2010 | Dreher | B64G 1/66 342/352 |
| 2010/0315288 | A1 * | 12/2010 | Liu | G01S 3/40 342/359 |
| 2011/0215964 | A1 * | 9/2011 | Shirakawa | G01S 13/003 342/25 R |

(Continued)

*Primary Examiner* — Marcus E Windrich

(74) *Attorney, Agent, or Firm* — McAndrews, Held & Malloy, Ltd.

(57) ABSTRACT

A direct-to-home satellite outdoor unit may comprise a reflector, a support structure, circuitry, and an array of antenna elements mounted to the support structure such that energy of a plurality of satellite beams is reflected by the reflector onto the array where the energy is converted to a plurality of first signals. The circuitry may be operable to process the first signals to concurrently generate a plurality of second signals, each of the second signals corresponding to a respective one of the plurality of satellite beams. The circuitry may be operable to process one or more of the second signals for outputting content carried in the one or more of the second signals onto a link to an indoor unit.

16 Claims, 10 Drawing Sheets

(56) References Cited

U.S. PATENT DOCUMENTS

2011/0267251 A1* 11/2011 Mathews ..... H01Q 1/288
343/779
2012/0306698 A1* 12/2012 Warnick ..... H01Q 5/35
342/372

* cited by examiner

SATELLITE RECEPTION ASSEMBLY WITH PHASED HORN ARRAY

PRIORITY CLAIM

This application claims priority to the following application(s), each of which is hereby incorporated herein by reference:

U.S. provisional patent application 61/753,138 titled "Satellite Reception Assembly with Phased Horn Array" and filed on Jan. 16, 2013.

INCORPORATION BY REFERENCE

This application makes also makes reference to the following application, which is hereby incorporated herein by reference:

U.S. patent application Ser. No. 13/687,626 titled "Method and System for an Internet Protocol LNB Supporting Sensors" and filed on Nov. 28, 2012.

BACKGROUND OF THE INVENTION

Conventional systems and methods for communications can be overly power hungry, slow, expensive, and inflexible. Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Systems and methods for communications, substantially as shown in and/or described in connection with at least one of the figures, as set forth more completely in the claims.

Advantages, aspects and novel features of the present disclosure, as well as details of various implementations thereof, will be more fully understood from the following description and drawings.

DETAILED DESCRIPTION OF THE INVENTION

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Figure 1A:
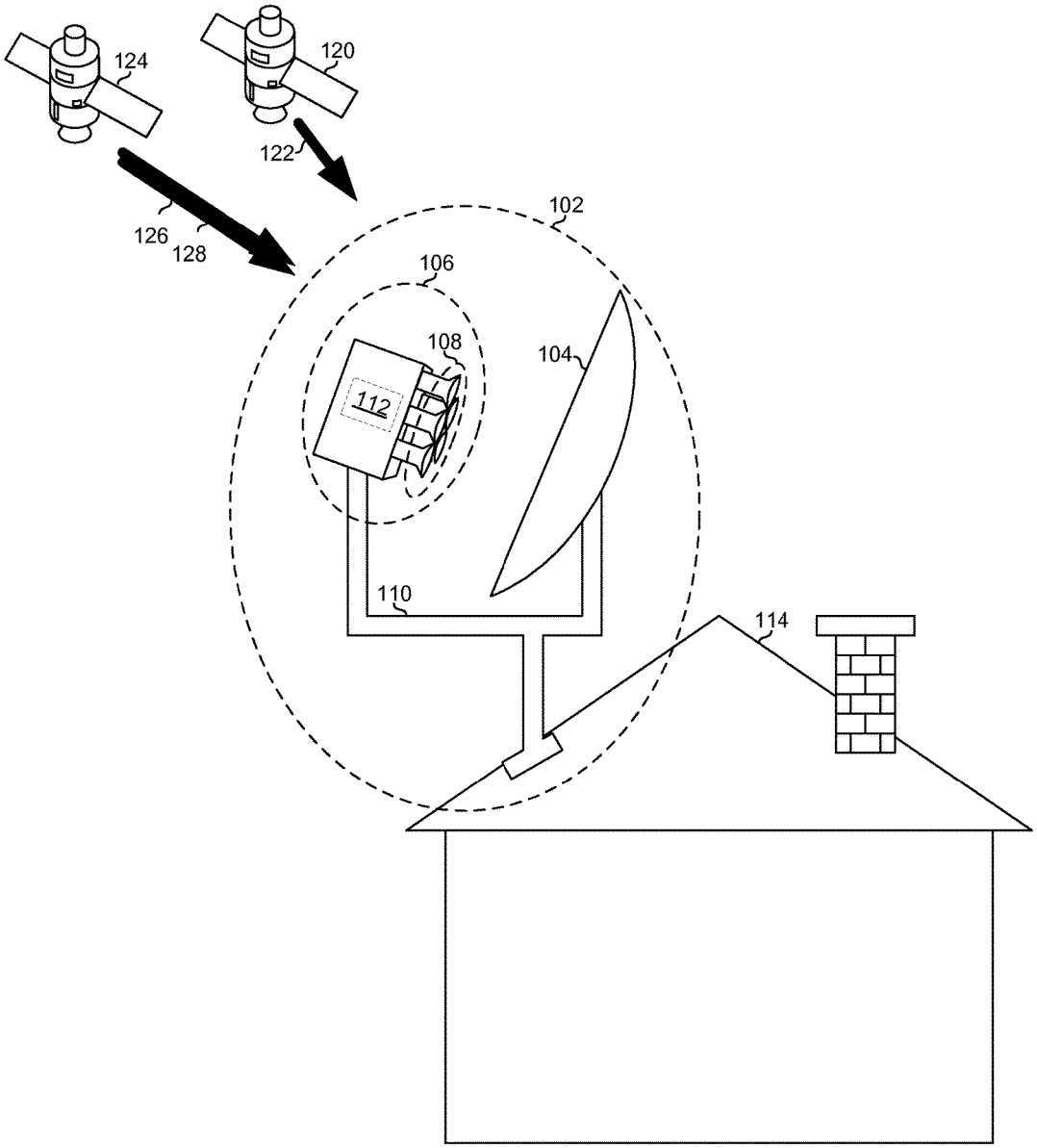
FIG. 1A is a diagram illustrating a satellite outdoor unit (ODU) comprising an array of antenna elements, and circuitry operable to reconstruct one or more satellite beams from the signals captures by the array.

FIG. 1A is a diagram illustrating a satellite outdoor unit (ODU) comprising an array of antenna elements, and circuitry operable to reconstruct one or more satellite beams from the signals captured by the array. Shown is an outdoor unit 102 which may be, for example, a direct broadcast satellite (DBS) or direct to home (DTH) ODU or "dish" (as opposed to an ODU or "dish" used for cable television distribution services) mounted to a home or office (or other stationary or moving object) 114 of a DBS/DTH subscriber for delivery of DBS/DTH data to the subscriber. Also shown are DBS/DTH satellites 120 transmitting beam 122 and satellite 124 transmitting beams 126 and 128. Each satellite beam may carry a respective data stream (e.g., comprising a particular one or more television stations). Each satellite beam may be characterized by a particular center frequency, polarization, and angle of incidence. For example, beams 126 and 128 may originate from the same satellite (and thus have essentially the same angle of incidence) and be on the same frequency, but have different polarizations.

The ODU 102 comprises a support structure 110 to which a reflector 104 (e.g., parabolic in shape) and a subassembly 106 are mounted. The subassembly may be mounted to a "boom" of the support structure such that it is at or near a focal point (or focal plane) of the reflector 104. The subassembly 106 may comprise an array 108 of antenna elements 116 (e.g., horns and/or microstrip patches), and circuitry 112 for processing signals received (and/or to be transmitted) via the reflector 104 and array 108. In an example implementation, the ODU 102 may be configured such that the reflector 104 and array 108 are operable collect a threshold amount of power from each of a plurality of satellite beams, such that the circuitry 112 can reconstruct the beams from the signals output by the array 108. While reconstruction of two beams 122 and 126 is used for illustration, any number of beams may be reconstructed based on details of a particular implementation.

Figure 1B:
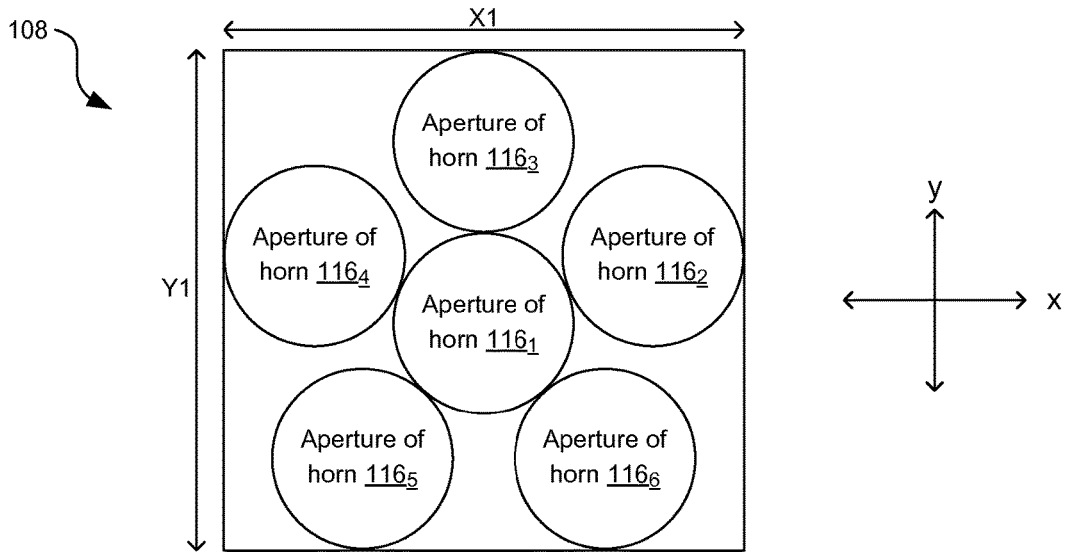
FIG. 1B depicts a first example configuration of the horn array of FIG. 1A.

Shown in FIG. 1B is an example implementation in which the array 108 is a pentagonal array of six circular feed horns comprising a center horn $\mathbf{116}_1$ and five surrounding horns $\mathbf{116}_2$-$\mathbf{116}_6$. The horns $\mathbf{116}_1$-$\mathbf{116}_6$ are arranged such that their outer dimensions are in physical contact, or close proximity, in an effort to keep the overall dimensions (X1, Y1) below a desired value. The arrangement of FIG. 1B is only an example, as other numbers and arrangements of horns are possible and contemplated (e.g., three horns in a triangular arrangement, four horns in a square or rectangular arrangement, five horns in a pentagonal arrangement, seven horns in a hexagonal arrangement, etc.). The arrangement of FIG. 1B may enable adjusting the radiation pattern along both the X axis and the Y axis (referenced as shown).

Figure 1C:
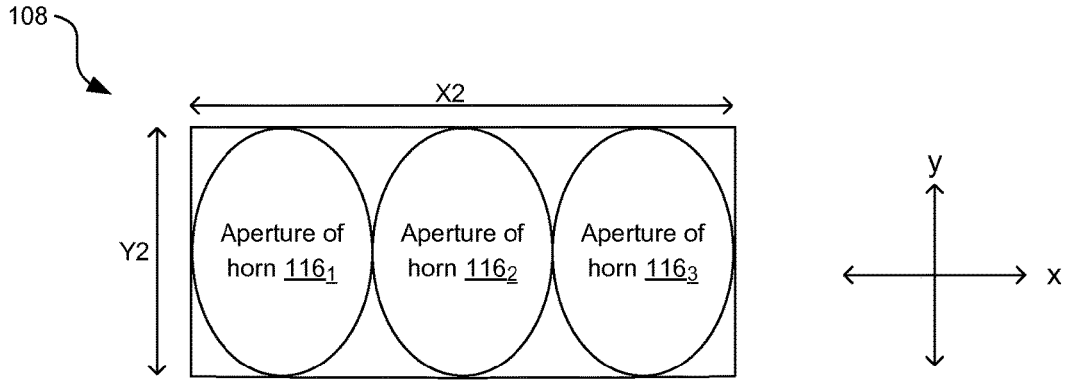
FIG. 1C depicts a second example configuration of the horn array of FIG. 1A.

FIG. 1C depicts a second example configuration in which the array 108 is a linear array of three elliptical, substantially non-circular horns $\mathbf{116}_1$-$\mathbf{116}_3$. Because all of the horns $\mathbf{116}_1$-$\mathbf{116}_3$ of FIG. 1C are aligned along the X axis, scanning in FIG. 1C is limited to the X direction while illumination in the Y direction is fixed. Nevertheless, this asymmetry is somewhat compensated for by the shape of the horns, which results in a wider beam pattern the Y direction than in the X direction. An advantage of the arrangement of FIG. 1C is that, relative to a conventional three-horn DBS dish, the overall dimensions (X, Y, and/or the area X*Y) of the array 108 in FIG. 1C may be smaller (thus reducing cost, wind loading, etc.) while still being able to illuminate the same amount, or perhaps even more of the reflector 104 (e.g., depending on the actual dimensions of the horns 1161-1163 and the range of angles over which the beam pattern can be steered in the X direction). For example, a conventional three-horn DBS/DTH antenna may have an X dimension X3 greater than X2.

Figure 2A:
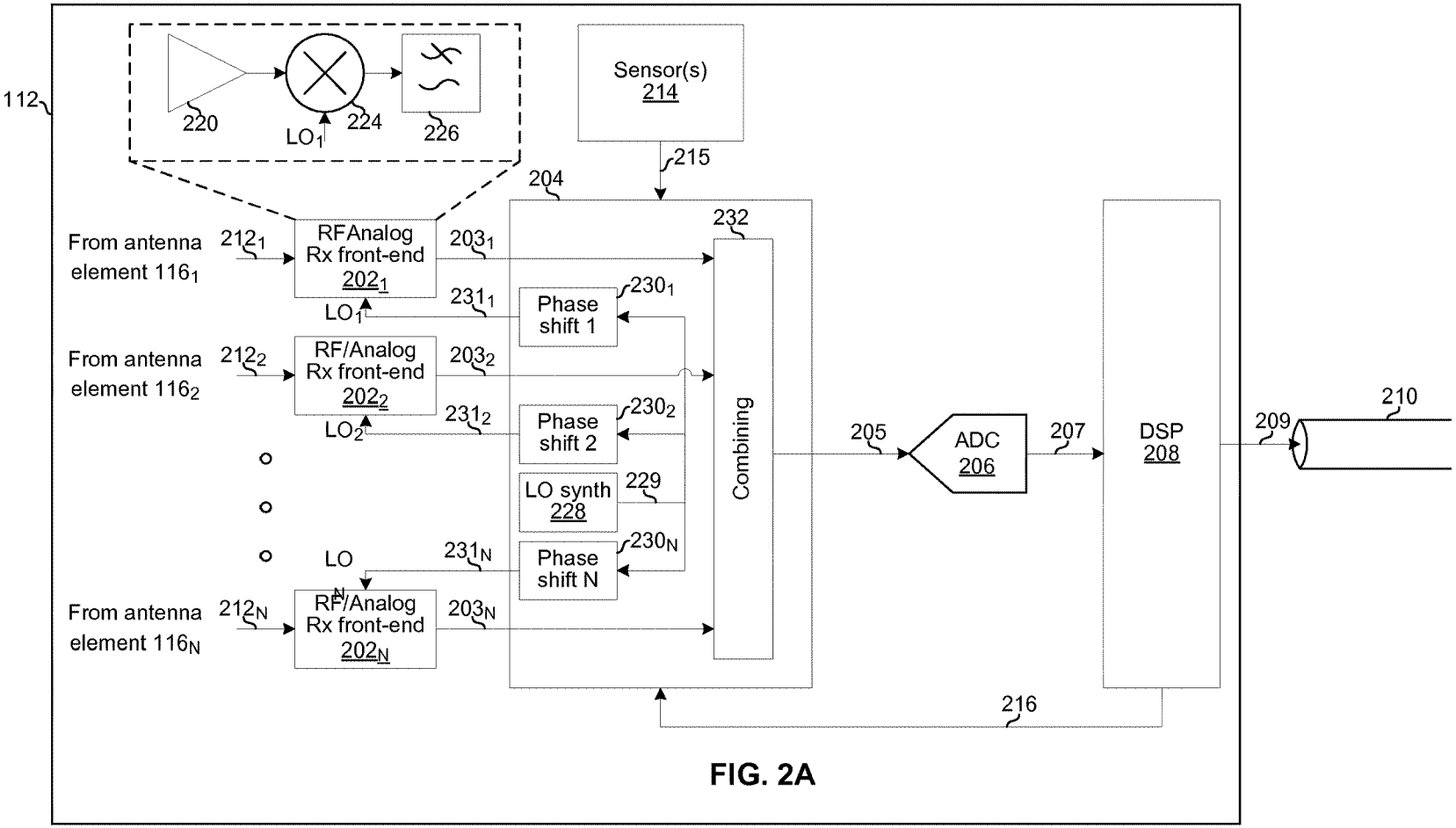
FIG. 2A depicts a first example implementation of the circuitry of FIG. 1A.

FIG. 2A depicts a first example implementation of the circuitry of FIG. 1A. In this example implementation, the circuitry 112 comprises receive front-ends $\mathbf{202}_1$-$\mathbf{202}_N$, a beam reconstruction circuit 204, analog-to-digital converter (ADC) 206, one or more sensors 214, and a digital signal processing (DSP) circuit 208. The circuit outputs signal 209 onto a link 210 (e.g., coaxial cable) to an indoor unit (IDU) (e.g., a "set-top-box" or "gateway").

The sensor(s) 214 may comprise, for example, a gyroscope, accelerometer, compass, and/or the like. The sensor(s) 214 may be operable to detect an orientation of the ODU 102, movement of the ODU 102, wind load on the ODU 102, and/or the like. The sensor(s) 214 may output readings/measurements as signal 215.

Each front-end circuit $\mathbf{202}_n$ ($1 \le n \le N$) is operable to receive (e.g., via microstrip, stripline, waveguide, and/or the like) a signal $\mathbf{212}_n$ from a respective antenna element $\mathbf{116}_n$. The front-end circuit 202 processes the signal $\mathbf{212}_n$ by, for example, amplifying it (e.g., via a low noise amplifier LNA 220), filtering it (e.g., via filter 226), and/or down-converting it (e.g., via mixer 226 to an intermediate frequency or to baseband). The local oscillator signals 231 for the down-converting may be generated by the circuit 204, as described below. The result of the processing performed by each circuit $\mathbf{202}_n$ is a signal $\mathbf{203}_n$.

The circuit 204 comprises local oscillator synthesizer 228 operable to generate a reference local oscillator signal 229, and phase shift circuits $\mathbf{230}_1$-$\mathbf{230}_N$ operable to generate N phase shifted versions of signal 229, output as signals $\mathbf{231}_1$-$\mathbf{231}_N$. The amount of phase shift introduced by each of the circuits $\mathbf{230}_1$-$\mathbf{230}_N$ may be determined by a corresponding one of a plurality phase coefficients. The plurality of phase coefficients may be controlled to achieve a desired radiation pattern for reconstructing a desired one or more of the satellite beams 122, 126, and 128.

Figure 2B:
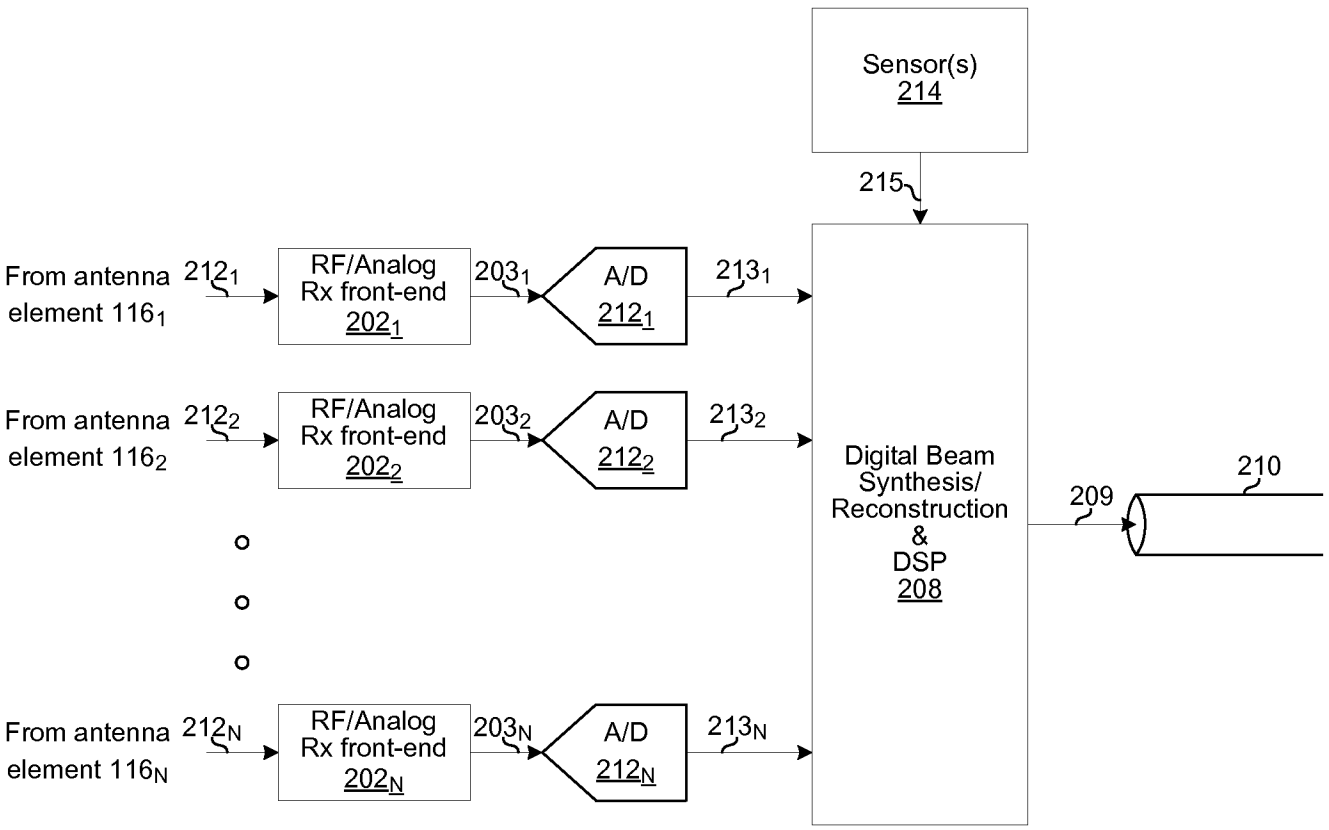
FIG. 2B depicts a second example implementation of the circuitry of FIG. 1A.
Figure 2D:
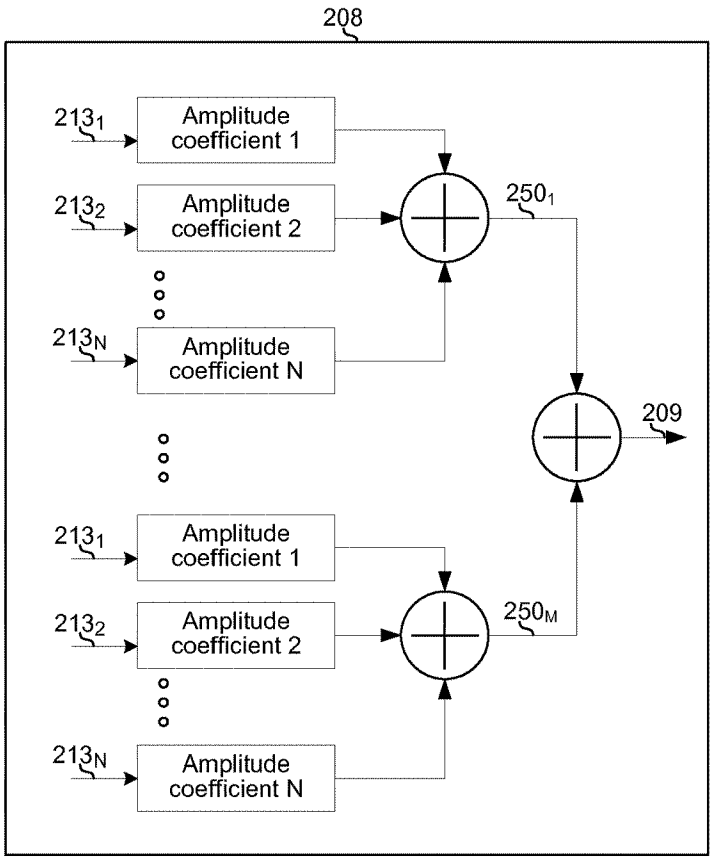
FIG. 2D depicts an example implementation of combining circuitry of the ODU of FIG. 2B.
Figure 2C:
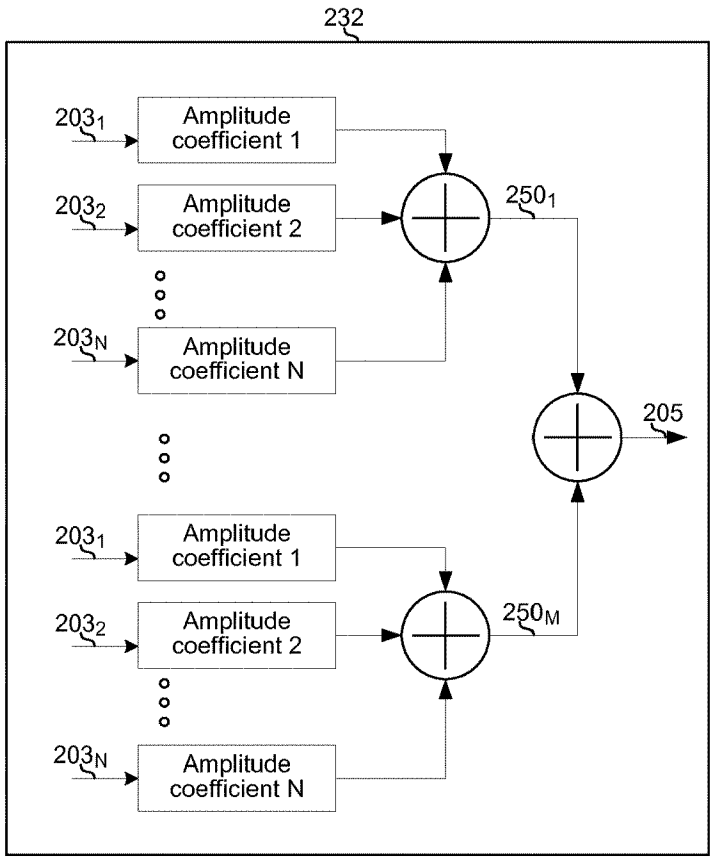
FIG. 2C depicts an example implementation of the combiner circuit of FIG. 2A.

Referring to FIG. 2C, the circuit 204 also comprises combining circuit 232 which is operable to receive the signals $\mathbf{203}_1$-$\mathbf{203}_N$, weight the amplitudes of the plurality of signals $\mathbf{203}_1$-$\mathbf{203}_N$ by a corresponding plurality of amplitude coefficients, and combine two or more of the weighted signals to reconstruct up to M satellite beams, such as beam 122, 126, and 128. Each of the signals $\mathbf{250}_1$-$\mathbf{250}_M$ may correspond to a satellite beam and the result of combining the beams $\mathbf{250}_1$-$\mathbf{250}_M$ is signal 205. Thus, the signal 205 may carry a plurality of satellite beams frequency division multiplexed onto a single signal path. The plurality of amplitude coefficients may be controlled to achieve a desired radiation pattern for reconstructing a desired one or more of the satellite beams 122, 126, and 128 as signals $\mathbf{250}_1$-$\mathbf{250}_M$.

In the example implementation of FIG. 2A, each of the reconstructed beam(s) $\mathbf{250}_1$-$\mathbf{250}_M$ may be at a lower frequency (e.g., in the L-band) than the frequency at which it was transmitted its respective satellite. In another example implementation where the circuits $\mathbf{202}_1$-$\mathbf{202}_n$ perform phase shifting but not downconversion, each of the reconstructed beam(s) $\mathbf{250}_1$-$\mathbf{250}_M$ be at the same frequency (e.g., in the Ka and/or Ku band) as transmitted by its respective satellite.

In another example implementation, a second instance of each of circuits $\mathbf{202}_1$-$\mathbf{202}_N$ and circuit 204 may be present to enable concurrent reception of a second satellite beam having the same frequency, but different polarization, than one of the satellite beam being reconstructed and output on signal 205.

Returning to FIG. 2A, the phase and amplitude coefficients may be controlled dynamically (i.e., concurrently with the ODU 102 processing received satellite beams for output to the IDU such that satellite content remains continuously available to the end-user) based on the measurements/readings from the sensor(s) 214. In this manner, the ODU 102 may compensate for static misalignment (e.g., introduced during installation or subsequently as a result of wind, getting hit by on object, etc.) and/or dynamic misalignment (e.g., twist and sway that comes and goes with the wind). In an example implementation, the phase and/or amplitude coefficients may be controlled by the DSP circuit 208 via signal 216.

Dynamically adjusting the phase and/or amplitude coefficients during reception of energy of satellite beams results in corresponding changes in the radiation pattern of the ODU 102. Different patterns may capture different amounts of power from different satellite beams. By adjusting the radiation pattern intelligently, sufficient energy from multiple beams may be captured during a single time interval such that content carried in each of the beams during that time interval can be demodulated and decoded with less than a threshold amount of errors. In other words, the "scanning" may effectively enable "illuminating" more of the reflector than could a single antenna element having the same dimensions as the dimensions of the array 108 (e.g., array 108 of FIG. 1B may illuminate more of the reflector 104 than could a single horn having dimensions X1 by Y1). As an example to illustrate, for a first radiation pattern (i.e., first set of phase and amplitude coefficients), power received from a first satellite beam (e.g., 122) may be above a threshold, but power received from a second satellite beam (e.g., 126) may be below the threshold. Conversely, for a second radiation pattern, power received from a first satellite beam (e.g., 122)

may be below the threshold, but power received from a second satellite beam (e.g., 126) may be above the threshold. Accordingly, by dwelling on each of the two positions for a sufficient percentage of a sufficiently short time interval, sufficient energy may be captured for each of the beams during that time interval such that the information on both beams during that time interval can be recovered.

The ADC 206 is operable to digitize signal 205 to generate signal 207. The bandwidth of the ADC 206 may be sufficient such that it can concurrently digitize multiple beams (e.g., the ADC 206 may have a bandwidth of 1 GHz or more).

The DSP circuit 208 is operable to process the digital signals 207 for output to an IDU as signal(s) 209. The processing may include, for example, interference (e.g., cross-polarization interference) cancellation. The processing may include, for example, channelization to select, for output to the IDU, the television stations, MPEG streams, etc. that are being requested by the IDU. The processing may include, for example, band translation and/or conversion back to analog for backward compatibility. The processing may include, for example, band stacking, channel stacking, band translation, and/or channel translation to increase utilization of the available bandwidth on the link 210.

The implementation of circuitry 112 shown in FIG. 2A may be realized on any combination of one or more semiconductor (e.g., Silicon, GaAs) dies and/or one or more printed circuit board. For example, each circuit $\mathbf{202}_n$ may comprise one or more first semiconductor dies located as close as possible to (e.g., a few centimeters from) its respective antenna element $\mathbf{116}_N$, the circuits 204 and 206 may comprise one or more second semiconductor dies on the same PCB as the first die(s), the circuit 208 may reside on one or more third semiconductor dies on the same PCB, and the sensor(s) 214 may be discrete components connected to the PCB via wires or wirelessly.

FIG. 2B depicts a second example implementation of the circuitry 112. In this example implementation, the beam reconstruction is performed in the digital domain in DSP circuit 208. That is, in addition to other functions performed by DSP circuit 208 (such as those described above), the digital circuitry may also perform phase and amplitude weighting and combining of the signals $\mathbf{213}_1$-$\mathbf{213}_N$, which are digitized versions of the signals $\mathbf{203}_1$-$\mathbf{203}_N$ output by the front-ends $\mathbf{202}_1$-$\mathbf{202}_N$.

Referring to FIG. 2C, the combining performed in circuit 208 may be similar to the combining performed in circuit 232 of FIG. 2C, with the exception that the scaling and combining is done in the digital domain in FIG. 2D as opposed to the analog domain as in FIG. 2C.

Returning to FIG. 2B, each ADC $\mathbf{212}_n$ is operable to digitize signal $\mathbf{203}_n$ to generate signal $\mathbf{213}_n$. The bandwidth of each ADC $\mathbf{212}_n$ may be sufficient such that it can concurrently digitize the entire satellite beam (e.g., the ADC 212*n* may have a bandwidth of 500 MHz or more).

The implementation of circuitry 112 shown in FIG. 2B may be realized on any combination of one or more semiconductor (e.g., Silicon, GaAs) dies and/or one or more printed circuit board. For example, each pair of $\mathbf{202}_n$ and ADC $\mathbf{212}_n$ may comprise an instance of a first semiconductor die and may be located as close as possible to (e.g., a few centimeters from) its respect antenna element $\mathbf{116}_N$, the circuit 208 may comprise an instance of a second semiconductor die on the same PCB as the first dies, and the sensor(s) 214 may be discrete components connected to the PCB via wires or wirelessly.

Figure 3A:
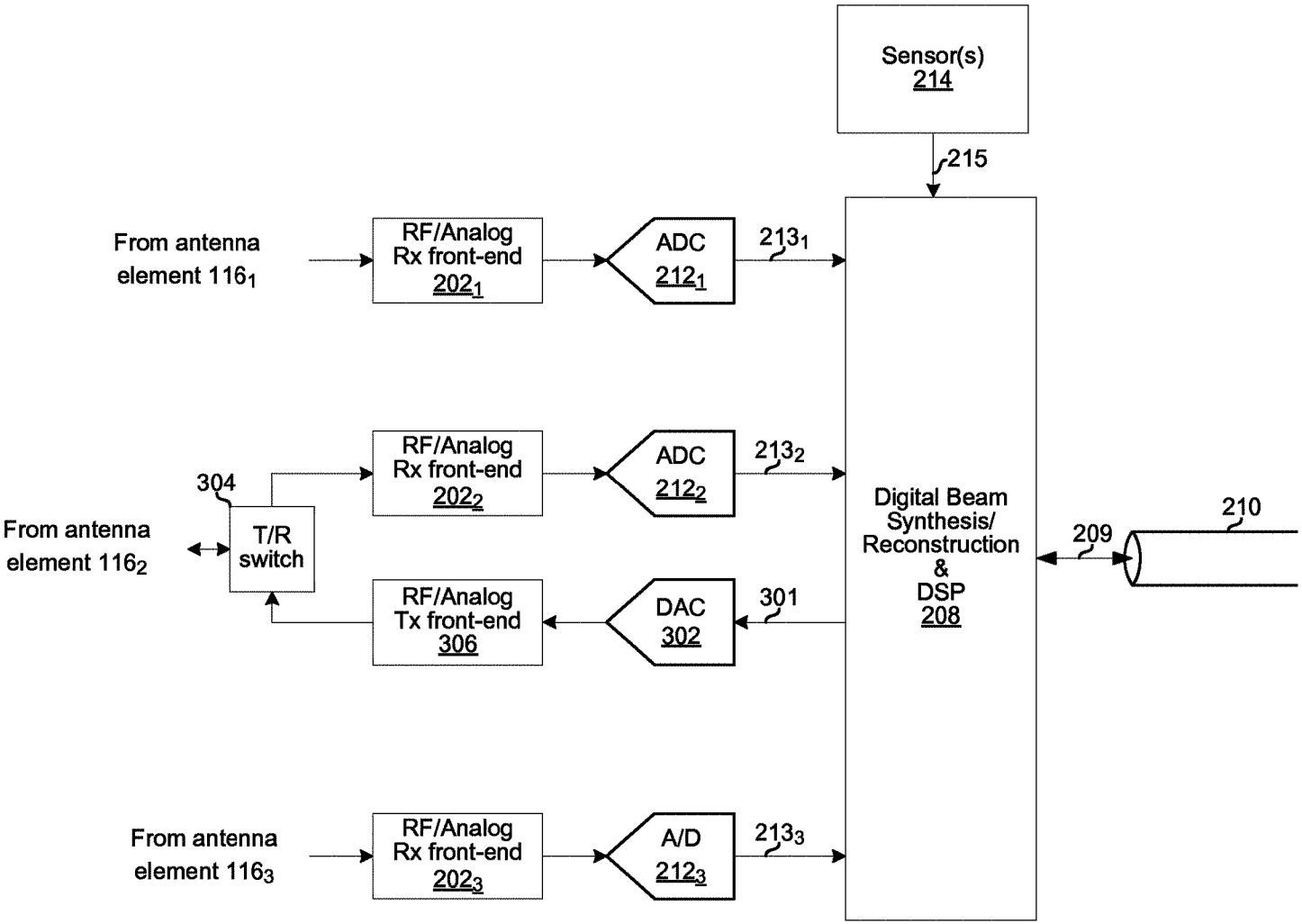
FIG. 3A depicts an example implementation in which a first subset of the antenna elements of the array are used for transmit and receive and second subset of the antenna elements are used only for receive.

FIG. 3A depicts an example implementation in which a first subset of the antenna elements 116 of the array 108 are used for transmit and receive, whereas a second subset of the antenna elements 116 of the array 108 are used only for receive. In FIG. 3A a three element array is used for illustration (i.e., n=3). Antenna element $\mathbf{116}_2$ is used for both transmit and receive, whereas antenna elements $\mathbf{116}_1$ and $\mathbf{116}_3$ are used only for receive. To support transmit and receive, antenna element $\mathbf{116}_2$ is coupled to a transmit/receive selection (T/R) switch 304. When the switch 304 is in the receive position, the antenna element $\mathbf{112}_2$ is coupled to the receive front-end $\mathbf{202}_2$. When the switch 304 is in the transmit position, the antenna element $\mathbf{112}_2$ is coupled to the transmit front-end 306.

The DAC 302 is operable to convert the signal 301, output by the circuit 208, to an analog representation.

The transmit front end 306 is operable to process (e.g., filter, upconvert, and amplify) signal 301 for transmission via the antenna element $\mathbf{116}_2$.

Receive performance of the antenna element $\mathbf{116}_2$ may suffer as a result of the additional signal routing to accommodate the switch 304 and losses in the switch 304 itself. Accordingly, by limiting transmit capabilities to a subset of the antenna elements (just one, in this example), the overall signal degradation owing to T/R switches may be kept below a threshold that may still enable high quality beam reconstruction. Having fewer Tx antenna elements than Rx antenna elements may also be enabled by characteristics of transmitted signals. For example, the ODU 102 may transmit at different frequencies than it receives and/or the necessary transmit throughput may be substantially lower than the necessary receive throughput. During design and/or configuration of the ODU 102 the number of receive antenna elements and the number of transmit antenna elements may be determined by the particular circumstances surrounding the installation of the particular ODU 102. In an example implementation, only a center horn of the array may be used for both transmit and receive while all others are used only for receive.

Figure 3B:
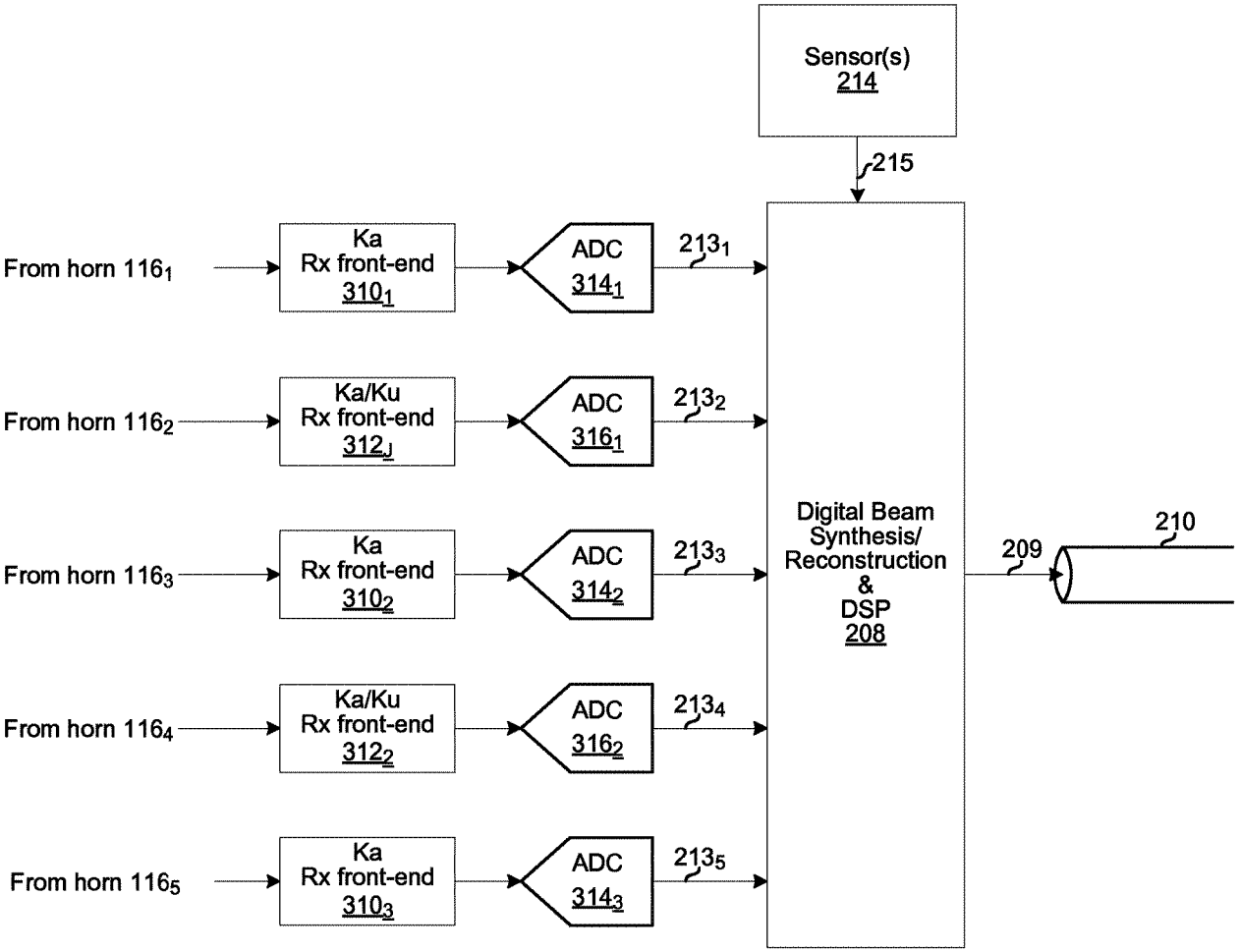
FIG. 3B depicts an example implementation in which a first subset of the antenna elements of the array are used for a first band and second subset of the antenna elements are used for a second band.

FIG. 3B depicts an example implementation in which a first subset of the antenna elements of the array are used for a single-band reception and second subset of the antenna elements are used for dual-band reception. Single-band reception may comprise, for example, receiving on either the Ka band or the Ku band. Dual-band reception may comprise, for example, receiving on both the Ka band and the Ku band.

In the example five-antenna-element implementation shown in FIG. 3B, of the five antenna elements 116, two are dual-band (e.g., Ka and Ku) and three are single band (e.g., Ka). The determination of how many antenna elements 116 and corresponding receive paths are dual band may be based, for example, on size and/or cost of the ODU 102. In this regard, circuits 312 and 316 that are operable to process both bands may need to operate over very wide bandwidth and/or support multiple modes corresponding to the multiple bands. Such wide bandwidth and/or multi-mode components may be larger and/or more expensive than narrow bandwidth, fixed components such as circuits 310 and 314.

Figure 4A:
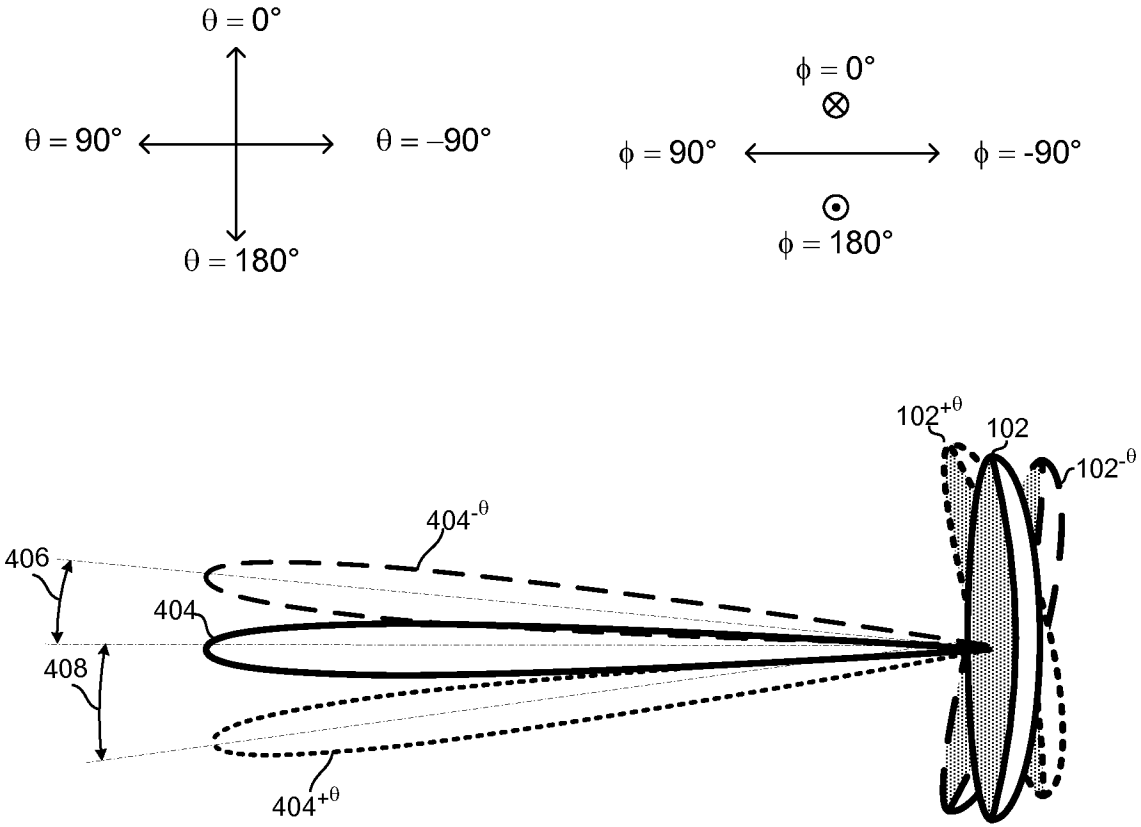
FIG. 4A illustrates dynamic correction of misalignment due to, for example, wind or imperfect installation.

FIG. 4A illustrates effects of twist and sway (e.g., due to wind or vibrations) on the directionality of the receive pattern of the ODU 102. For reference a coordinate system comprising angles $\theta$ and $\phi$ is shown, with the angle $\theta$ sweeping along the plane of the page and the angle $\phi$ sweeping along a plane perpendicular to the page.

The ODU 102 in its nominal position ($\theta$=0° and $\phi$=0°) is labeled 102 and corresponds to receive pattern 404. The ODU 102 twisting/swaying in the negative $\underline{\theta}$ direction is labeled $102^{-\theta}$ and corresponds to receive pattern $404^{-\theta}$. The ODU 102 twisting/swaying in the positive θ direction is labeled $102^{+\theta}$ and corresponds to receive pattern $404^{+\theta}$. The maximum angular deflection of receive pattern 404 in the +θ direction is indicated by arc 408. The maximum angular deflection of receive pattern 404 in the −θ direction is indicated by arc 406. Although not shown, similar angular deviations of the radiation pattern in the +ϕ and −ϕ directions may occur.

In an example implementation, the maximum angular deviations (such as 406 and 408), due to twist/sway, along the θ axis and/or ϕ axis may be determined (e.g., statistically based on the particular configuration/material/etc. of the ODU 102) and the array 108 and circuitry 112 may be configured to be able to sufficiently steer the radiation pattern such that even during maximum deflection along one or both of the axes, sufficient SNR (or other quality metric) is maintained.

Figure 4B:
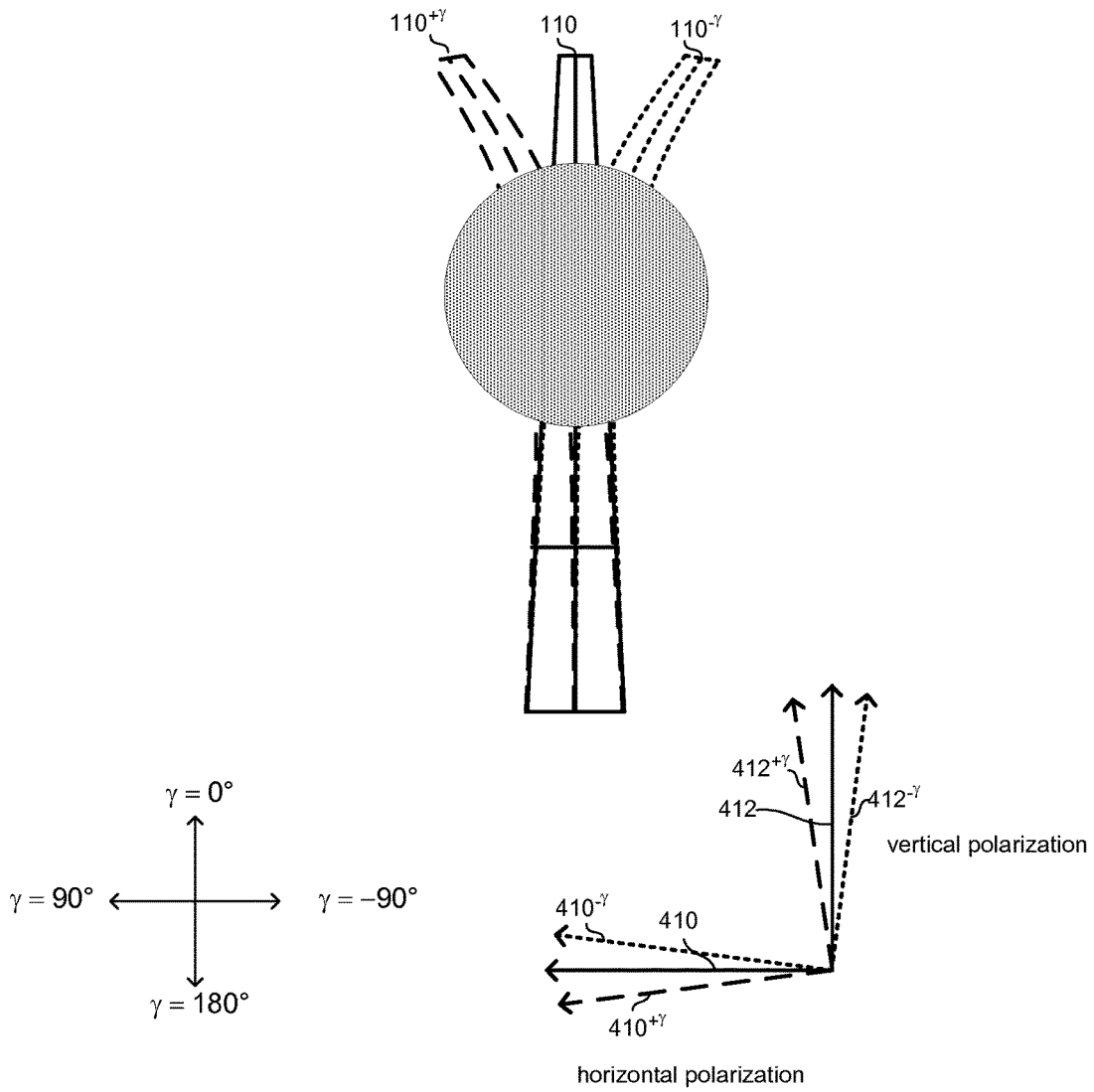
FIG. 4B illustrates dynamic correction of polarization misalignment due to, for example, wind or imperfect installation.

FIG. 4B illustrates effects of sway (e.g., due to wind or vibrations) on the polarization orientation of the ODU 102. Note that although such sway may not typically be a problem where the support structure 110 is relatively short and sturdy, it may be more significant where the support structure is taller (e.g., to get around a line-of-sight obstruction) and/or more flexible (e.g., to reduce weight of the ODU 102, size of the ODU 102, and/or cost of materials). For reference a coordinate system comprising angle γ is shown, with the angle γ sweeping along the plane of the page.

Shown is a front view of the ODU 102 mounted on a tall and/or relatively flexible support structure 110. The support structure 110 in its nominal positions is shown by solid lines. The nominal horizontal polarization shown is as solid line 410, and the nominal vertical polarization is shown as solid line 412. The ODU 102 swaying in the negative γ direction is shown by dotted lines, with corresponding horizontal polarization shown by dotted line $410^{-\gamma}$, and corresponding vertical polarization shown by dotted line $412^{-\gamma}$. The ODU 102 swaying in the positive γ direction is shown by dashed lines, with corresponding horizontal polarization shown by dashed line $410^{+\gamma}$, and corresponding vertical polarization shown by dashed line $412^{+\gamma}$. The angular deviation of the polarizations may result in increased cross-polarization interference.

In an example implementation, the ODU 102 may be operable to detect deviations in the γ direction (e.g., based on RSSI measurements and/or the sensor(s) 214) and adjust cross-polarization cancellation operations in the circuit 208 accordingly.

Figure 5:
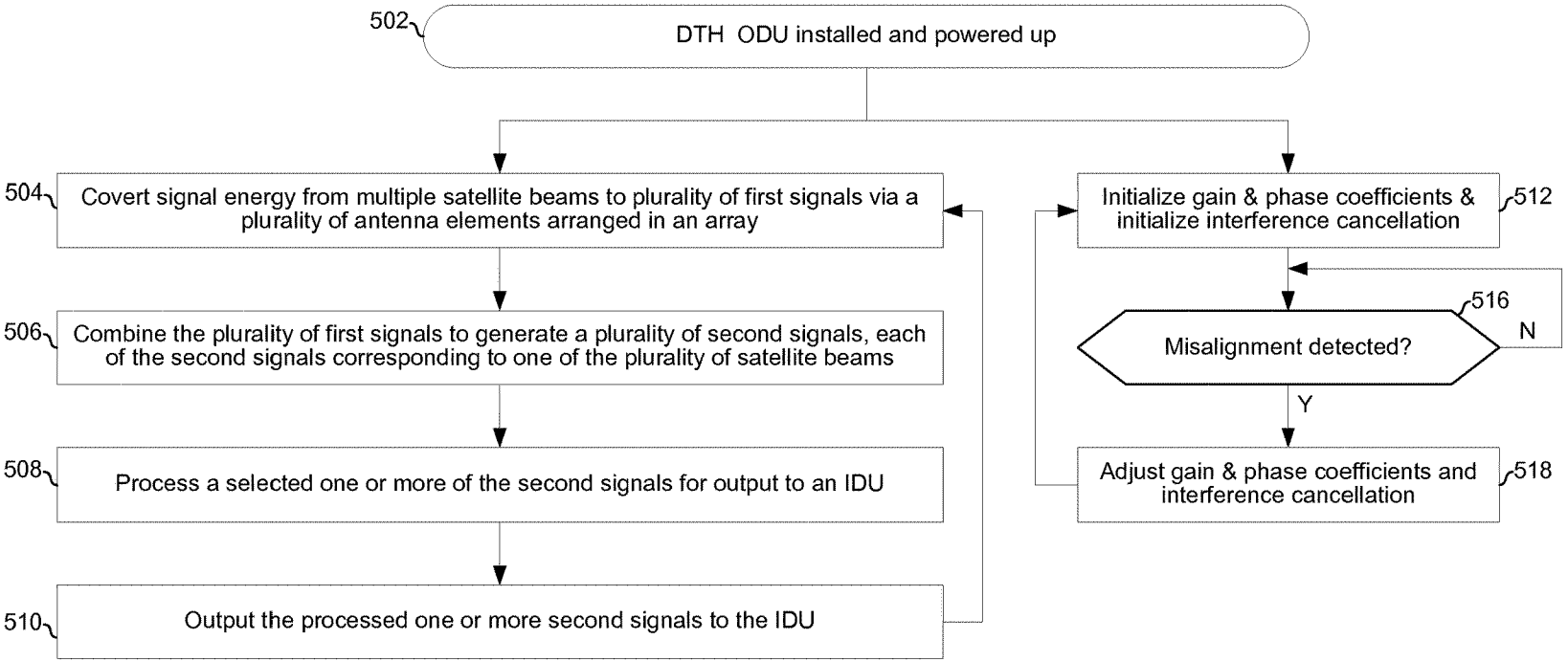
FIG. 5 is a flowchart illustrating an example process for operation of the circuitry of FIG. 1A.

FIG. 5 is a flowchart illustrating an example process for operation of the circuitry of FIG. 1A. In block 502, the ODU 102 is installed at the home or office of a DTH subscriber and powered up (e.g., by connecting to an IDU via link 210 and powering up the IDU). After block 502, the process may proceed along two paths in parallel. The first path comprises blocks 504 through 510 and the second path comprises blocks 512 through 518.

In block 504, the signal energy from multiple satellite beams is captured by the array 108 and output as a plurality of first signals $212_1$-$212_N$. In block 506, the plurality of first signals are combined to generate a plurality of second signals $250_1$-$250_M$. In block 508, the plurality of second signals are processed (e.g., combined, channelized, filtered, channel/band stacked, and/or the like) for output to the IDU. In block 510, the processed signal(s) (e.g., a channel-stacked group of selected channels) are output to the IDU via the link 210.

In block 512, initialization of: (1) gain and phase coefficients used for combining the signals $212_1$-$212_N$ to reconstruct satellite beams, and/or (2) parameters for interference (e.g., cross-polarization interference) cancellation, occur(s). The initialization may be based on current position/alignment of the ODU 102 and which satellite beam(s) carry content that is currently requested by the IDU. In block 514, the ODU 102 may detect (e.g., based on signal measurements and/or readings/measurements from the sensor(s) 214) a change in alignment/orientation of the ODU 102. In block 516, the gain and phase coefficients and/or interference cancellation parameters may be adjusted based on the detected change in alignment/orientation.

Other embodiments of the invention may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the methods described herein.

Accordingly, the present invention may be realized in hardware, software, or a combination of hardware and software. The present invention may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A system comprising:

a direct-to-home (DTH) satellite outdoor unit (ODU), the ODU comprising:

a reflector;

a support structure;

one or more sensors operable to detect movement of said ODU;

an array of antenna elements mounted to said support structure such that energy of a plurality of satellite beams is reflected by said reflector onto said array where said energy is converted to a plurality of first signals, each of said plurality of first signals comprising a magnitude and a phase; and circuitry operable to:

receive said plurality of first signals;

process said plurality of first signals to concurrently generate a plurality of second signals while adaptively cancelling cross-polarization interference, the cross-polarization interference being adaptively cancelled based on an amplitude adjustment applied to said plurality of first signals, said amplitude adjustment being determined according to an angular deviation of said array of antenna elements, each of said second signals corresponding to a respective one of said plurality of satellite beams, wherein said processing of said plurality of first signals comprises dwelling on a first position and dwelling on a second position, and wherein said processing of said plurality of first signals comprises combining energy captured at the first position by said plurality of first signals with energy captured at the second position by said plurality of first signals, and wherein, as part of said processing of said first signals to concurrently generate said second signals, said circuitry of said ODU is operable to:

apply a plurality of phase coefficients and a plurality of amplitude coefficients to said first signals, and dynamically control said plurality of phase coefficients and said plurality of amplitude coefficients to change a directionality of a radiation pattern of said array while said ODU concurrently receives and outputs said satellite content onto said link to said IDU, wherein said dynamic control of said plurality of phase coefficients and said plurality of amplitude coefficients is based on movement of said ODU detected by said sensors;

process, during a time interval, one or more of said second signals for output of satellite content carried in a corresponding one or more of said satellite beams onto a link to an indoor unit (IDU);

compensate for said angular deviation through an adjustment of one or more phase coefficients and one or more amplitude coefficients to generate a receive pattern in order to scan a different satellite; and concurrently process, during said time interval, one or more of said second signals for output of satellite content, carried in said different satellite beam, onto said link to said IDU, wherein:

said ODU comprises one or more sensors operable to detect movement of said ODU; and said dynamic control of said plurality of phase coefficients and said plurality of amplitude coefficients is based on movement of said ODU detected by said sensors.

2. The system of claim 1, wherein said circuitry is operable to digitize each of said first signals prior to said processing of said first signals to concurrently generate said second signals.

3. The system of claim 1, wherein:

said circuitry is operable to perform said processing of said first signals to concurrently generate said second signals in the analog domain; and said circuitry is operable to digitize said second signals as part of said processing of said one or more of said second signals.

4. The system of claim 1, wherein each of said antenna elements is a horn having an aperture, said aperture having a first dimension longer than a second dimension.

5. The system of claim 1, wherein said circuitry of said ODU is operable to measure received signal strength; and said dynamic control of said plurality of phase coefficients and said plurality of amplitude coefficients is based on said received signal strength.

6. The system of claim 1, wherein:

a first portion of said antenna elements are used only for reception; and a second portion of said antenna elements are used for both reception and transmission.

7. The system of claim 6, wherein:

said antenna elements are arranged in an array such that a first one of said antenna elements is at or near a center of said array and other ones of said antenna elements are arranged around a perimeter of said first one of said antenna elements;

said first one of said antenna elements is used for transmission and reception;

said other ones of said antenna elements are used only for reception.

8. The system of claim 1, wherein:

each of said antenna elements is a horn having an aperture that is larger along a first axis than along a second axis perpendicular to said first axis;

as part of said processing of said first signals to concurrently generate said second signals, said circuitry is operable to:

dynamically control a plurality of phase coefficients and a plurality of amplitude coefficients such that a directionality of a radiation pattern of said array scans over a range of angles along said second axis while said directionality of said radiation pattern of said array remains fixed along said first axis.

9. A method comprising:

in a direct-to-home (DTH) satellite outdoor unit (ODU) comprising a reflector, a support structure, an array of antenna elements mounted to said support structure such that energy of a plurality of satellite beams is reflected by said reflector onto said array:

converting, by said reflector and said array, said energy to a plurality of first signals, each of said plurality of first signals comprising a magnitude and a phase;

processing, by a signal processor, said plurality of first signals to concurrently generate a plurality of second signals while adaptively cancelling cross-polarization interference, the cross-polarization interference being adaptively cancelled based on an amplitude adjustment applied to said plurality of first signals, said amplitude adjustment being determined according to an angular deviation of said array of antenna elements, each of said second signals corresponding to a respective one of said plurality of satellite beams, wherein said processing of said plurality of first signals comprises dwelling on a first position and dwelling on a second position, and wherein said processing of said plurality of first signals comprises combining energy captured at the first position by said plurality of first signals with energy captured at the second position by said plurality of first signals, and wherein said processing of said first signals to concurrently generate said second signals comprises:

applying a plurality of phase coefficients and a plurality of amplitude coefficients to said first signals, and dynamically controlling said plurality of phase coefficients and said plurality of amplitude coefficients to change a directionality of a radiation pattern of said array while said ODU concurrently receives and outputs said satellite content onto said link to said IDU, wherein said ODU comprises one or more sensors operable to detect movement of said ODU, and wherein said dynamic controlling of said plurality of phase coefficients and said plurality of amplitude coefficients is based on movement of said ODU detected by said sensors;

processing, by said signal processor during a time interval, one or more of said second signals for outputting satellite content carried in a corresponding one or more of said satellite beams onto a link to an indoor unit (IDU);

compensating said angular deviation by adjusting one or more phase coefficients and one or more amplitude coefficients, thereby generating a receive pattern to scan a different satellite beam; and concurrently processing, during said time interval, one or more of said second signals for output of satellite content, carried in said different satellite beam, onto said link to said IDU.

10. The method of claim 9, comprising performing by an analog-to-digital converter: digitizing each of said first signals prior to said processing said first signals to concurrently generate said second signals.

11. The method of claim 9, wherein said processing of said first signals to concurrently generate said second signals is performed in the analog domain; and said processing of said one or more of said second signals includes digitizing said second signals.

12. The method of claim 9, wherein each of said antenna elements is a horn having an aperture, said aperture having a first dimension longer than a second dimension.

13. The method of claim 9, comprising:

measuring, by said circuitry, received signal strength; and dynamically controlling said plurality of phase coefficients and said plurality of amplitude coefficients based on said received signal strength.

14. The method of claim 9, comprising:

receiving, but not transmitting, via a first portion of said antenna elements; and receiving and transmitting via a second portion of said antenna elements.

15. The method of claim 14, wherein said antenna elements are arranged in an array such that a first one of said antenna elements is at or near a center of said array and other ones of said antenna elements are arranged around a perimeter of said first one of said antenna elements, and the method comprises:

transmitting and receiving via said first one of said antenna elements; and receiving, but not transmitting, via said other ones of said antenna elements.

16. The method of claim 9, wherein each of said antenna elements is a horn having an aperture that is larger along a first axis than along a second axis perpendicular to said first axis, and said processing of said first signals to concurrently generate said second signals comprises:

dynamically controlling a plurality of phase coefficients and a plurality of amplitude coefficients such that a directionality of a radiation pattern of said array scans over a range of angles along said second axis while said directionality of said radiation pattern of said array remains fixed along said first axis.

* * * * *